US005193818A

United States Patent [19]

Leeson

[11] Patent Number: 5,193,818

[45] Date of Patent: Mar. 16, 1993

[54] GAME

[76] Inventor: Garry Leeson, R.R. #5, Kingston, Nova Scotia, B0P 1R0, Canada

[21] Appl. No.: 818,913

[22] Filed: Jan. 10, 1992

[51] Int. Cl.[5] ..... A63F 1/00; A63F 9/18; A63F 9/22

[52] U.S. Cl. ..... 273/430; 273/308; 273/434

[58] Field of Search ..... 273/430, 299, 434, 296, 273/302, 308; 434/130

[56] References Cited

U.S. PATENT DOCUMENTS 1,263,664 4/1918 Hanada ..... 273/296
1,745,946 2/1930 Murray ..... 273/308 X
4,558,865 12/1985 Isgar ..... 273/430 X

*Primary Examiner*—William H. Grieb
*Attorney, Agent, or Firm*—Burke-Robertson

[57] ABSTRACT

A game in the form of a parlor game, video game or television game for purposes of entertainment. The game comprises a plurality of distinct, arbitrarily selectable information units, each unit being divided into two independently viewable sub-units. The first sub-unit has a visual representation of a different, recognizable object and the second sub-unit is a visual representation of the identity of that object and questions and answers concerning that object. Means are provided for the selection of a particular question by the player and for accumulating the player's score based on proper answers to the questions. For the parlor game form of the game, the units comprise two-sided cards, the first side displaying a photograph of an object and the second side the identity of the object and a plurality of questions concerning the object and answers to those questions.

12 Claims, 2 Drawing Sheets

GAME

The present invention relates to a game, and more particularly to a game which may be played as a parlor game, video game or television game for purposes of entertainment.

BACKGROUND OF THE INVENTION

Games, and particularly board games having cards with questions to answer which dictate a person's progress towards the goal of the game are well-known. It is an object of the present invention however to provide a novel and unique game which is played with a card or other medium which displays a photograph, in conjunction with questions relating to the subject of the photograph.

SUMMARY OF THE INVENTION

In accordance with the present invention there is provided a game which comprises a plurality of distinct, arbitrarily selectable information units. Each unit is divided into two, independently viewable sub-units, the first sub-unit being a visual representation of a different, recognizable object and the second sub-unit being a visual representation of the identity of that object and questions and answers concerning that object. Means are provided for selection of a particular question by a player, and for accumulating the player's score based on proper answers to the questions.

A preferred form of the invention is a parlor game which comprises a plurality of two-sided cards. The first side displays a photograph of a different, recognizable object and the second side displays the identity of the object, a plurality of questions concerning the object and the answers to those questions.

The game may also take the form of a video game comprising a video game cartridge programmed with a plurality of pre-scanned images of different, recognizable objects so as to appear individually and randomly on a monitor when selected. Each randomly selected image appears with a plurality of wrong identification means and a single correct identification name to select from, selection of the correct identification name resulting in appearance on the monitor of a first in a series of questions concerning the object, the correct answering of the question resulting in the appearance of a next question in that series. A further randomly selected image appears on a monitor upon incorrect answering of the image name or incorrect answer of a question.

In yet another embodiment of the game according to the present, the game may be played as a television game wherein three video monitors are provided, a plurality of images of different recognizable objects appearing individually and randomly on one of the monitors, the identity of and questions concerning that image appearing when required on a second of the monitors and answers to the corresponding question appearing when required on the third monitor.

BRIEF DESCRIPTION OF THE DRAWINGS

These and other objects and advantages of the invention will become apparent upon reading the following detailed description and upon referring to the drawings in which.

While the invention will be described in conjunction with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE DRAWINGS

Figure 1:
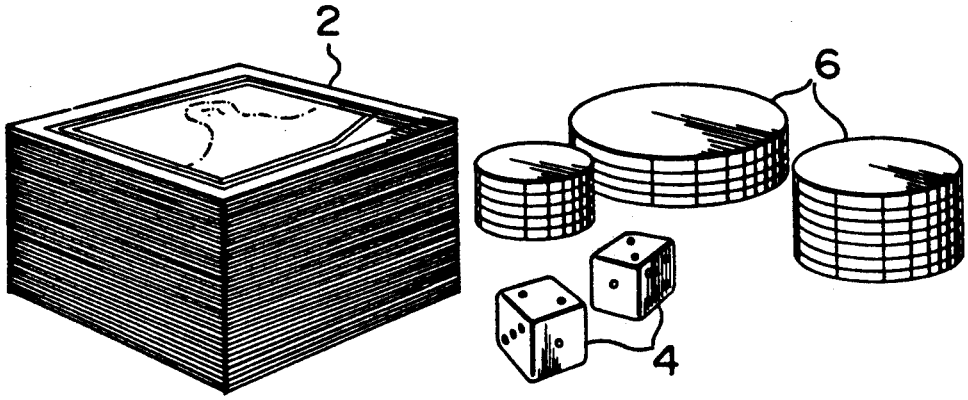
FIG. 1 is a perspective view of the components of the parlor game of the present invention.
Figure 2:
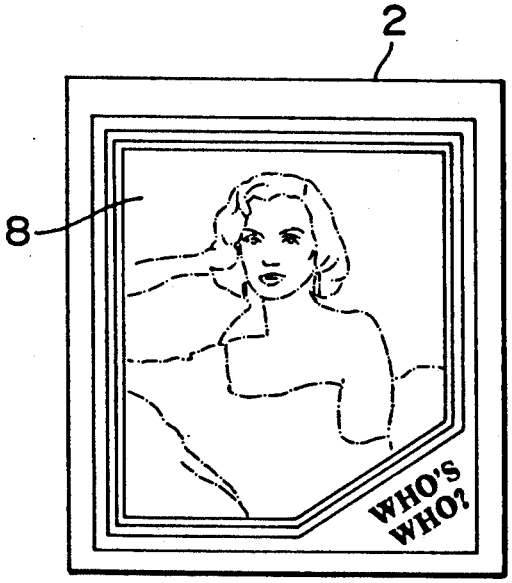
FIGS. 2 and 3 are respectively views of each side of a card of the game of FIG. 1.
Figure 3:
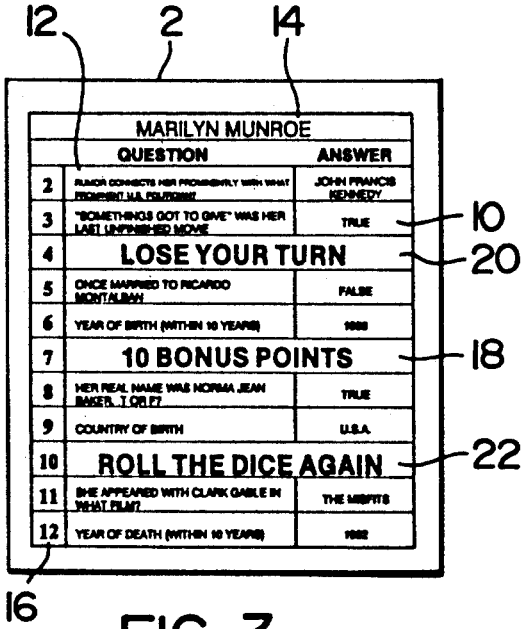

Turning to FIGS. 1, 2 and 3 there are illustrated the components of applicant's game, when played as a parlor game. In this format, the game comprises several hundred two-sided cards 2, a pair of dice 4 and multi-valued chips 6 for keeping score. As illustrated in FIGS. 2 and 3, the cards are two-sided. The front 8 of the card (FIG. 2) displays the picture of a famous person as illustrated, and on the back 10 are listed various questions 12 pertaining to the person on the front of the card. As well that person's name 14 is identified at the top of the card. To one side of the questions 12 are numbers 16 particular to that particular question and to the other side are the answers to the question. Beside some of the numbers 16, instead of questions and answers, are bonus directions 18, penalty directions 20 or player activity directions 22 as illustrated. Numbers 16 comprise each of the numbers in the range of 2 to 12, these being the numbers which any roll of the dice 4 may produce. Proposed rules of the game are as follows:

(A) Any number of people may play with the position of "Quiz Master" being determined by the highest score on an initial toss of the dice. It is the duty of the "Quiz Master" to take a card from the top of a previously shuffled deck, and hold it in a position such that the picture on the front is visible to all players but the questions on the back are visible only to himself.

(B) The "Quiz Master" gives the player on his immediate left first chance to identify the famous person depicted on the front of the card. If successful, the player accumulates 5 points and goes on to roll the dice, answer further questions and accumulate more points. If the player fails to identify the person on the front of the card, the opportunity passes in a clockwise direction, from left to right, with the points increasing by 5 points each time a player fails to identify the famous person and until a successful identification is made. If all players fail to identify the famous person, the "Quiz Master" reveals the name and the card goes out of play to the bottom of the deck.

(C) Points are scored in the following fashion. Players receive 5 or more points for successfully identifying the famous person. Players then roll the dice and attempt to answer the questions, corresponding to the value of the roll, as seen on the back of the card. This number also determines the number of points accumulated.

If a question is answered correctly, the player continues to roll the dice until:

(1) He answers incorrectly (2) He duplicates a roll (3) He gets (lose your turn)

(4) He finishes all the questions related to a particular famous person

Figure 4:
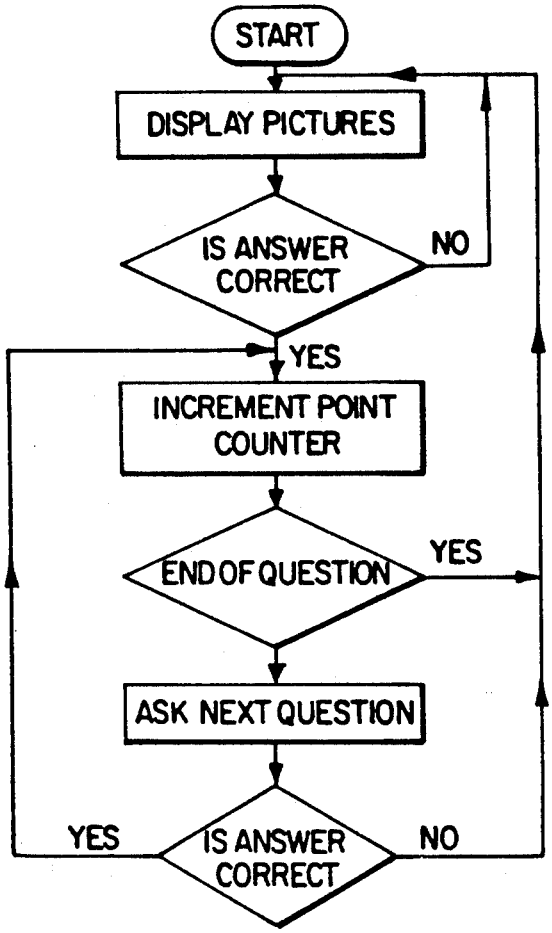
FIG. 4 is a flow chart of the commands when the game of the present invention is played on a programmed video game cartridge.

When played as a video game, as shown in FIG. 4, a game cartridge is programmed such that several hundred pre-scanned images of famous persons are induced to appear randomly on a monitor. Players score points by identifying famous people and answering various questions pertaining to that person. The cartridge is programmed so that value points are associated with the correct identification of an image name or question relating to an image, and to a accrue a person's points during the playing of the game. Examples rules of the game would be as follows:

(A) Any number of people may play. After an order of play is established, players retain that order throughout the game.

(B) First player presses a key and a randomly selected image appears with for example six names to choose from. The player identifies the famous person by pressing the key corresponding to the correct name. If successful in identifying the famous person, the player progresses through a series of questions accruing points as he goes along and continuing until he answers incorrectly.

(C) Should player #1 answer all questions correctly, he continues on to the next famous person and the next, etc. until he misses.

(D) Points are allocated to individual players on an ongoing basis till the end of the game. The player with the highest points is the winner.

The control functions of the program of the game cartridge are illustrated on the flow sheet of FIG. 4.

Figure 5:
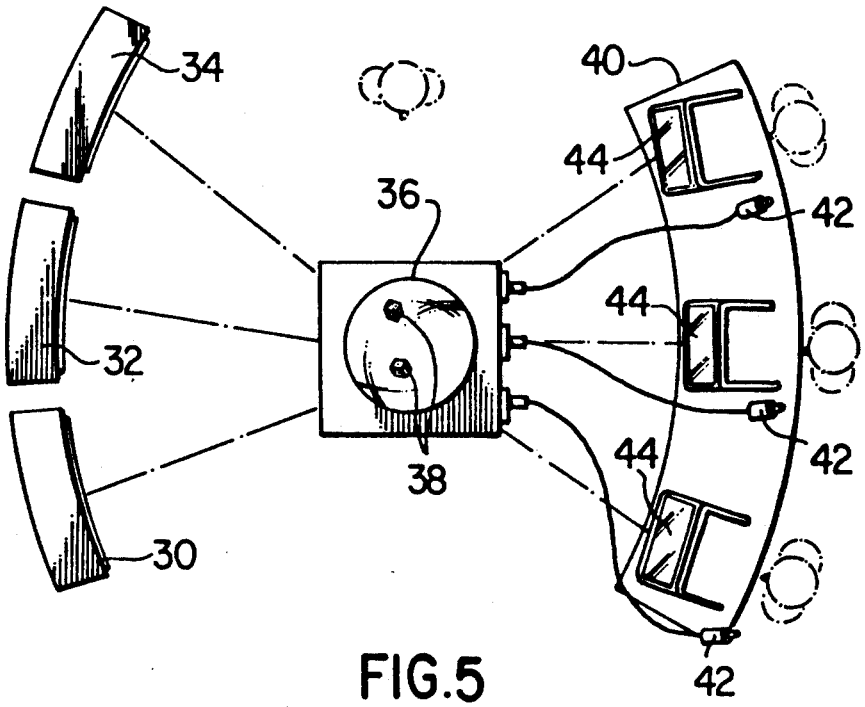
FIG. 5 is a schematic view of the components of the game when played in a television studio.

When played as a TV game show, as illustrated in FIG. 5, the stage may be set with three video screens 30, 32 and 34. A clear plastic sphere 36, containing a large pair of dice 38 is situated directly in front of and below the video screens. The contestants would be situated at a desk 40 placed in a broad semicircle around the dice sphere 36, with a Master of Ceremonies between them and the video screens. Each player would roll the dice 38 individually by activating a remote control button 42 from his or her position. The order by which the contestants participate would be pre-determined by a toss of the dice and that order would be continued through the game.

Players would score points by identifying famous people as they are displayed randomly on video screen 30. After successful identification, players accumulate additional points by answering questions about the people they have identified. The questions, determined by a roll of the dice 38, will appear on video screen 32, with the answer being confirmed on video screen 34. Each player's points will be displayed on a screen 44 located in front of his desk as they are accumulated.

The rules of this game may be as follows:

(A) The Master of Ceremonies, after introducing himself and the competitors, gives player #1 (stage left) first opportunity to identify the first famous person. If successful, the player accumulates five points and goes on to roll the dice, answer further questions and accumulate more points. (The order and difficulty of the question is determined by the roll of the dice, example: roll 12, answer question 12, get 12 points if successful. There is no penalty for questions answered incorrectly).

(B) If the player fails to identify the famous person displayed, the opportunity passes to player #2 and then #3 etc. with the points increasing by 5 each time a player fails to identify the famous person and until a successful identification is made.

(C) If all players fail to identify the person, the Master of Ceremonies will disclose the name and go on to the next one.

(D) If a question is answered correctly, the player continues to roll the dice until:

(1) He answers incorrectly (2) He duplicates a roll (3) He gets (lose your turn)

(4) He finishes all the questions related to a particular famous person

Thus it is apparent that there has been provided in accordance with the invention an improved game, and more particularly a game which may be played as a parlor game, video game or television game for purposes of entertainment that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A game comprising a plurality of distinct, arbitrarily selectable information units, each unit divided into two, independently viewable sub-units, the first sub-unit being a visual representation of a different, recognizable object and the second sub-unit being a visual representation of the identity of that object and questions and answers concerning that object, means for selection of a particular question by a player and means for accumulating the player's score based on proper answers to the questions, the information units comprising a plurality of two-sided cards, the first sub-units and second sub-units respectively being on first and second sides of the cards, the first side displaying a photograph of a different, recognizable object and the second side displaying the identity of the object, a plurality of questions concerning the object and the answers to those questions, and the game further comprising a random number-selection device for a range of numbers, a different one of the numbers in that range visually associated with each question on the second side of the card.

2. A parlor game according to claim 1 wherein the random number-selection device comprises a pair of conventional six-sided dice and the numbers on said second side of the card are from 2 to 12.

3. A parlor game according to claim 1 further provided with reward means for players correctly answering the question.

4. A parlor game according to claim 3 wherein the second side of the card is further provided with bonus and penalty award spaces, a different one of the numbers in the range being associated with each of the bonus and penalty award spaces.

5. A parlor game according to claim 3 wherein the reward means comprises a plurality of differing and similar chips, similar chips representing a similar value.

6. A parlor game according to claim 1 wherein the photographs displayed on the cards are of famous people and the questions relate to facts concerning the lives of those people.

7. A video game comprising a plurality of distinct, arbitrarily selectable information units, each unit divided into two, independently viewable sub-units, the first sub-unit being a visual representation of a different, recognizable object and the second sub-unit being a visual representation of the identity of that object and questions and answers concerning that object, means for selection of a particular question by a player and means for accumulating the player's score based on proper answers to the questions, the game comprising a video game cartridge programmed with the information units comprising the first sub-units as a plurality of pre-scanned images of different, recognizable objects so as to appear individually and randomly on a monitor when selected, each randomly selected image appearing with the second sub-units comprising a plurality of wrong, and a single correct, identification names to select from, selection of the correct identification name resulting in appearance on the monitor of further second sub-units comprising a first in a series of questions concerning the object, the correct answering of the question resulting in the appearance of a next question in that series, a further randomly selected image appearing on a monitor upon incorrect answering of the image name or incorrect answer of a question.

8. A video game according to claim 7 wherein the images are of famous players.

9. A video game according to claim 7 wherein value points are associated with correct identification of an image name and correct answering of a question relating to an image, and the cartridge is programmed to accrue a player's value points during the playing of the game.

10. A game intended for playing with contestants on television, comprising a plurality of distinct, arbitrarily selectable information units, each unit divided into two, independently viewable sub-units, the first sub-unit being a visual representation of a different, recognizable object and the second sub-unit being a visual representation of the identity of that object and questions and answers concerning that object, means for selection of a particular question by a player and means of accumulating the player's score based on proper answers to the questions, wherein three video monitors are provided, and the first sub-units of the information units are a plurality of images of different recognizable objects appearing individually and randomly on one of the monitors, and the second sub-units of the information units comprise the identity of and questions concerning that image appearing when required on a second of the monitors and answers to the corresponding question appearing when required on the third monitor.

11. A television game according to claim 10 further comprising, for the contestants, a random number selection device for a range of numbers, each of the questions for a particular image being associated with a different one of the numbers in the range.

12. A television game according to claim 11 wherein the random number selection device comprises a pair of six-sided dice, the sides numbered from 1 to 6, and the numbers in a range being from 2 to 12.

* * * * *